United States Patent [19]

O'Brien et al.

[11] Patent Number: 5,029,712

[45] Date of Patent: Jul. 9, 1991

[54] RECLOSURE STICK GUM PACKAGE

[75] Inventors: Denise M. O'Brien, Flemington; Carlo P. Croce, Leonia, both of N.J.

[73] Assignee: Warner-Lambert Company, Morris Plains, N.J.

[21] Appl. No.: 474,970

[22] Filed: Feb. 2, 1990

[51] Int. Cl.[5] ..... B65D 5/54

[52] U.S. Cl. ..... 206/621; 206/622; 206/625; 206/628

[58] Field of Search ..... 206/622, 625, 800, 268, 206/628, 621, 604

[56] References Cited

U.S. PATENT DOCUMENTS

| | | | |
|---|---|---|---|
| 3,093,292 | 6/1963 | Ahlbor | 206/625 |
| 3,606,133 | 9/1971 | Meyers | 206/622 |
| 3,735,914 | 5/1973 | Collura et al. | 206/625 |
| 3,814,301 | 6/1974 | Niepmann | 206/622 |
| 4,142,635 | 3/1979 | Capo et al. | 206/622 |
| 4,192,420 | 3/1980 | Worrell et al. | 206/621 |
| 4,613,046 | 9/1986 | Kuchenbecker | 206/622 |

FOREIGN PATENT DOCUMENTS

| | | | |
|---|---|---|---|
| 7709326 | 8/1977 | Netherlands | 206/622 |

*Primary Examiner*—William I. Price

*Attorney, Agent, or Firm*—Daniel A. Scola, Jr.; Richard S. Bullitt

[57] ABSTRACT

A reclosable package for holding items comprises a container having a front portion, top end portion and back portion. An adhesive front label is applied to the front portion of the container. A flexible adhesive flap is then applied which covers the label, top end, and back portions of the container. The label and front portion of the container has a contoured edge formed therein to define an opening edge. The flap includes a non-adhesive pull tab. Lifting the pull tab detaches the front portion along the contoured edge and also removes the top end to open the package. The back of the flap remains attached to the back of the package to form a hinged connection. The flap is resealable to the front portion of the package, to allow the package to be reclosed.

11 Claims, 1 Drawing Sheet

RECLOSURE STICK GUM PACKAGE

FIELD OF THE INVENTION

This invention relates generally to material packaging. More particularly, this invention relates to reclosable packaging for confectioneries. The present invention is particularly, but not exclusively, useful for packaging of stick chewing gum.

BACKGROUND OF THE INVENTION

In the area of packaging pieces of confectionary, particularly stick gum, it has been customary to package the individual sticks of gum in a flexible package. Conventional packages typically hold a small number of pieces, e.g. five, and are opened by manipulating a narrow strip or cord which is wrapped around one end of the package. For the conventional gum package, one end of the strip or cord is exposed and pulling on this end unwraps the strip to tear open the end of the package and expose the stick gum. The torn-off end of the package and the strip are then no longer useful and become refuse which must be discarded. Also, once such conventional packages are opened to remove one or more sticks of gum, they cannot be reclosed. The end of the package remains open, and there is no lid or cover to reclose the package. The package must be maintained in an upright position to keep the pieces from falling out. Adhesion between individual sticks of gum and the package itself is relied upon to retain the remaining sticks of gum in the open package. This is often unsatisfactory and inconvenient. In addition, since the sticks of gum are exposed to the elements, they often dry out quickly and become brittle. Thus, they do not remain fresh for long after the package is opened.

Other methods of packaging stick gum have been used over the years. For example, adhesively attaching the wrappers of individual sticks to one another within the package has been used to attempt to retain sticks of gum inside the package once it has been torn open. As sticks of gum are removed, however, the empty wrappers remain attached to one another in the package and this results in a bulky empty package. In addition, conventional stick gum packaging which uses a tearoff end is sometimes not easy or convenient to open. Further, none of the conventional packaging methods discussed above contemplate actual reclosure of the container to retain and reseal the remaining sticks of gum in the container subsequent to the initial opening of the package.

It is, therefore,. an object of the present invention to provide a stick gum package which is easy to open. It is another object of the present invention to provide a stick gum package which is reclosable to contain the unused sticks of gum after initial opening, and to reseal them in the package. It is a further object of the present invention to provide a reclosable package for stick gum which is simple and convenient to use. It is another object of the present invention to provide a method for constructing a reclosable stick gum package which is cost effective, and may easily be adapted for use in connection with conventional stick gum packaging technology. While the preferred embodiment, described below, pertains to stick gum wrapping, the present invention may be used in connection with any similar container in which individual units of a commodity are packaged.

SUMMARY OF THE INVENTION

A preferred embodiment of the reclosable package comprises a sealed container, having a top end which is to be opened to remove the contents. An adhesive label is affixed to and covers a front portion of the container, adjacent the top end. A scored front opening contour, which penetrates both the label and the front portion, defines an opening in the container. A flexible flap is adhesively secured to the container to cover the top end. The flap has front, middle, and back adhesive portions. The front adhesive portion of the flap adheres to the front label affixed to the front of the container. The top adhesive portion of the flap adheres to the top end of the container and the back adhesive portion of the flap adheres to a back portion of the container adjacent the top end. The flap has a non-adhesive pull tab portion which extends from the front adhesive portion. There are resealable adhesive areas on the front of the label along the outside of the scored contour which resist permanent adhesion of the flap.

Lifting the pull tab lifts the flap. This detaches the portion of the container inside the scored contour and then the top end from the container, to open the container to expose the contents The flap may then be closed to cover the now opened container. The front adhesive portion of the flap may be resealed to the exposed resealable adhesive areas of the label on the front portion of the container.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
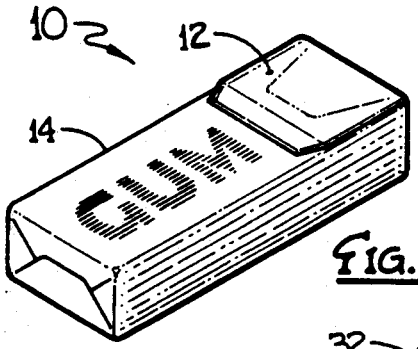
FIG. 1 is a perspective view of the reclosable package according to the present invention in a closed state.

Referring to FIG. 1, there is shown the reclosable stick gum package, generally designated 10. As shown, package 10 comprises a container 14 for containing confectionary, such as stick gum. Container 14 is constructed as a conventional stick gum package made of a flexible sheet material which is folded and sealed to contain the sticks. The material is a conventional sheet material used for gum wrapping.

Figure 2:
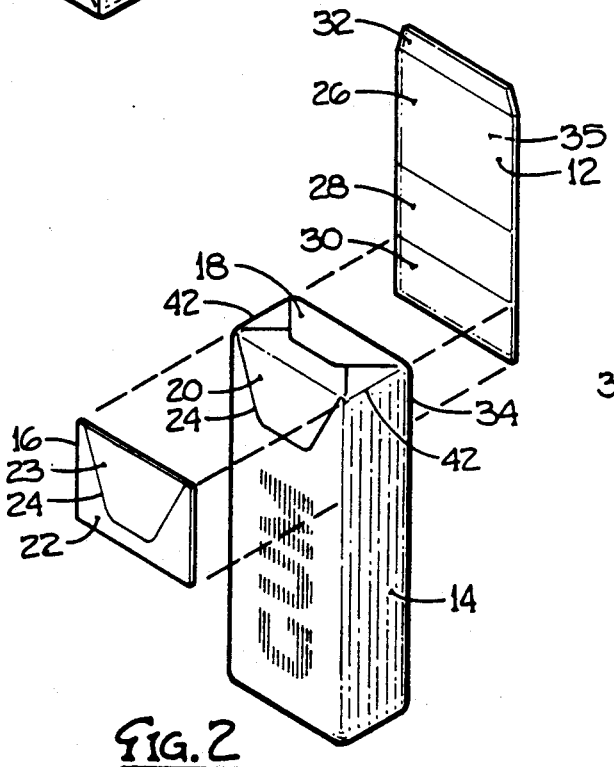
FIG. 2 is an exploded perspective view of components of the package shown in FIG. 1.

Referring now to FIG. 2, it can be seen that a flexible adhesive backed flap 12 is fastened to top end 18 of container 14. Flap 12 may be composed of any packaging material suitable and compatible for confectionary wrapping. In addition to flap 12, there is a pressure sensitive adhesive front label 16 which is glued by an adhesive to front portion 20 of container 14, adjacent top end 18 of container 14. It will be appreciated by those skilled in the art that front label 16 may be securely fixed to front portion 20 of container 14 by any feasible method of adhesion. In the manufacture of the preferred embodiment, front label 16 adheres to front portion 20, and has a cut or scored contour 24 formed therein which penetrates both label 16 and front 20 portion of container 14. This contour 24 forms an edge which defines a trapezoidal-shaped opening 40. As will be appreciated by the skilled artisan, contour 24 can be either die-cut or laser cut. If the contour 24 is laser cut, this cutting can be accomplished in a separate operation prior to the assembly of gum package 10. There is a resealable adhesive area 22 on the front of the label around the outside of the contour 24. Resealable adhesive area 22 resists permanent adhesion of adhesive-backed flap 12, so that it may be removably attached to the resealable adhesive area 22.

It will be appreciated by those skilled in the art that the shape of the contour or cut 24 may be any shape conducive to allow removal of confections from package 10, yet forming an opening with a geometry suitable for reclosure. As depicted in FIG. 2, the shape of contour 24 is substantially trapezoidal in the preferred embodiment.

Figure 3:
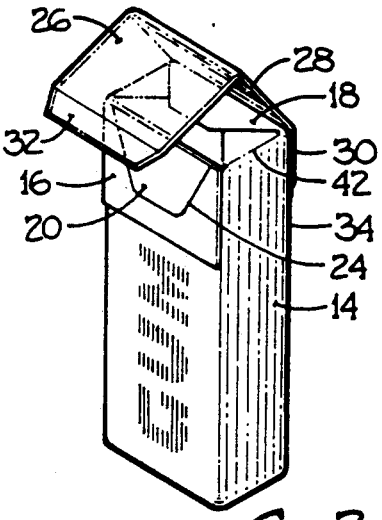
FIG. 3 is a perspective view of the package illustrating a step in its manufacture.

As further shown in FIGS. 2 and 3, flap 12 is attached to container 14 so that it covers front label 16. Flap 12 is preferably in the form of a pressure sensitive material having an adhesive backing. The underside of flap 12 is comprised of adhesive front portion 26, adhesive middle portion 28, and adhesive back portion 30. Attached to front portion 26 is a non-adhesive pull tab 32 used for opening package 10 as later described. Flap 12 is reinforced with an extra layer of wrapping material in the preferred embodiment to avoid wear over a multiplicity of open/reclose cycles. Back portion 30 of flap 12 is affixed to back 34 of container 14. Middle portion 28 of flap 12 is affixed to top end 18. Front portion 26 of flap 12 is affixed to front label 16, which label 16 is affixed to front portion 20. The type of material used for flap 12 in the embodiment of FIG. 3 is an adhesive film or tape material which is transparent. This permits writing and other advertisements which may be printed on first pressure sensitive label 16 and package 10 to appear for viewing.

Adhesive front portion 26 has portions which extend beyond cut 24 and adheres to resealable adhesive area 22 on front label 16 which is adhered to front portion 20. As may be appreciated by the skilled artisan, adhesive front portion 26 of flap 12 may be coated with any suitable substance known in the art that maintains its adhesive quality over several open/reclose cycles against resealable adhesive area 22. Yet, it permanently adheres flap 12 to top end 18 and to area 23 of front portion 20 located inside contour 24. The outer side 35 of flap 12 is not coated with any adhesive material, so that it forms part of the outside protective layer of container 14. The flap 12 is firmly secured to container 14 as shown in FIG. 1.

OPERATION

Figure 4:
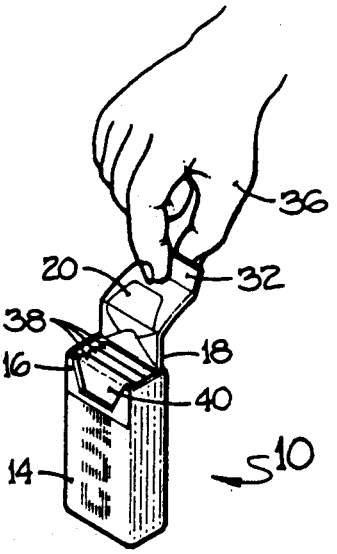
FIG. 4 is a perspective view of the package in an opened state.

Referring to FIG. 4, it has been found that a convenient method of operating the preferred embodiment is for a user to comfortably grasp package 10, and hold package 10 in a substantially upright position as shown. Then, with the thumb and forefinger of free hand 36, the user can grasp pull tab 32 and lift. This detaches area 23 of front portion 20 from container 14 along contour 24. Further lifting action tears off top end 18 of container 14 along folded edges 42 of top end 18, and package 10 is thus opened. Adhesive back portion 30 keeps flap 12 securely attached to back 34 of container 14. Flap 12 thus remains hingedly connected to container 14. An opening 40 is thus defined by contour 24, edges 42 to allow access to the contents inside package 10. Selected sticks of gum 38 can then be removed from the open package 10.

The package 10 may then be reclosed to cover and reseal opening 40. To accomplish this, pull tab 32 is grasped between the thumb and forefinger of free hand 36 to replace flap 12 over opening 40 to cover the opening 40 of package 10. Light pressure is then applied by the user to front adhesive portion 26 of flap 12. This adheres front adhesive portion 26 to resealable adhesive area 22 which is permanently affixed to container 14. This reseals flap 12 to close package 10. Package 10 may be reopened and reclosed as many times as necessary until all of stick gum 38 is depleted.

While the particular reclosable stick gum package as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

We claim:

1. A reclosable package, comprising:

a hollow container having a back portion, a top end, and a front portion, said front portion provided with a means for defining an edge for an opening and provided with a sealing surface; and a flexible flap adhesively attached to and extending from said back portion, adhesively secured to and covering said top end and adhesively secured to said means for defining said edge for said opening while being resealably adhered to said sealing surface of said front portion of said container, said flap being movable between an open position wherein said top end is removed from said container to form an opening defined by said edge and said top end, and a closed portion for sealing said flap against said front of said container to cover said opening;

whereby said package can be repeatedly, adhesively resealed after repeated reopenings which occur subsequent to an initial opening of said package.

2. A reclosable package comprising:

a hollow container having a back portion, a top end, and a front portion having an edge for developing an opening and a front label securely fixed to said front portion, said front label having an edge formed by a die-cut; and a flexible flap adhesively attached to and extending from said back portion, adhesively secured to and covering said top end and said front portion of said container, said flap being movable between an open position wherein said top end is removed from said container to form an opening defined by said edge and said top end, and a closed position for sealing said flap against said front of said container to cover said opening.

3. A reclosable package as recited in claim 2, wherein said label includes a resealable adhesive area.

4. A reclosable package as recited in claim 1, wherein said flap is an adhesive-backed sheet material.

5. A reclosable package as recited in claim 4, wherein said flap is transparent.

6. A reclosable package, comprising:

a container having a plurality of faces and formed with a contour for defining an opening in said container wherein said opening comprises substantially the entire surface of at least one face of said container; and a flap hingedly and adhesively connected to said container for covering said opening, said flap having an adhesive portion for resealing said flap to said container to cover said opening, said flap further having a non-adhesive pull tab for grasping said flap to move said flap between an open position wherein said opening is uncovered, and a closed position wherein said opening is covered by at least part of said flap.

7. A reclosable package as recited in claim 6, wherein said flap includes an adhesive front portion for engaging said container to hold said flap in said closed position.

8. A reclosable package as recited in claim 6, further comprising a front label securely and adhesively fixed to said front portion, said front label having a contoured edge.

9. A reclosable package as recited in claim 8, wherein said front label includes a resealable adhesive portion.

10. A reclosable package as recited in claim 6, wherein said flap is an adhesive-backed sheet material.

11. A reclosable package as recited in claim 10, wherein said flap is transparent.

* * * * *